US007967952B2

(12) United States Patent
Williams et al.

(10) Patent No.: US 7,967,952 B2
(45) **Date of Patent: *Jun. 28, 2011**

(54) DURABLE PAPER

(75) Inventors: Richard C. Williams, Loveland, OH (US); Graciela Jimenez, Mason, OH (US); Benny J. Skaggs, Springboro, OH (US)

(73) Assignee: International Paper Company, Memphis, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/707,703

(22) Filed: Feb. 18, 2010

(65) Prior Publication Data

US 2010/0173138 A1 Jul. 8, 2010

Related U.S. Application Data

(63) Continuation of application No. 11/497,796, filed on Aug. 1, 2006, now Pat. No. 7,666,274.

(51) Int. Cl.
*D21H 13/02* (2006.01)
*D21H 13/24* (2006.01)

(52) U.S. Cl. ..... 162/146; 162/157.3; 162/141; 428/340; 428/221

(58) Field of Classification Search ..... 162/141, 162/146, 157.1–157.7, 123; 428/221, 364–365, 428/373–377, 340

See application file for complete search history.

(56) References Cited

U.S. PATENT DOCUMENTS

| | | | |
|---|---|---|---|
| 2,962,414 | A | 11/1960 | Arledter |
| 2,999,788 | A | 9/1961 | Morgan |
| 3,028,296 | A | 4/1962 | Adams et al. |
| 3,266,972 | A | 8/1966 | Cramer |
| 3,489,643 | A | 1/1970 | Hoffman |
| 3,674,621 | A | 7/1972 | Miyamoto et al. |
| 4,007,083 | A | 2/1977 | Ring et al. |
| 4,022,965 | A | 5/1977 | Goheen et al. |
| 4,049,491 | A | 9/1977 | Brandon et al. |
| 4,075,136 | A | 2/1978 | Schaper |
| 4,166,894 | A | 9/1979 | Schaper |
| 4,174,417 | A | 11/1979 | Rydell |
| 4,200,488 | A | 4/1980 | Brandon et al. |
| 4,431,481 | A | 2/1984 | Drach et al. |
| 4,466,862 | A | 8/1984 | Ring et al. |
| 4,496,427 | A | 1/1985 | Davison |
| 4,496,583 | A | 1/1985 | Yamamoto et al. |
| 4,512,849 | A | 4/1985 | Brandon et al. |
| RE32,182 | E | 6/1986 | Ring et al. |
| 4,986,882 | A | 1/1991 | Mackey et al. |
| 5,009,747 | A | 4/1991 | Viazmensky et al. |
| 5,049,235 | A | 9/1991 | Barcus et al. |
| 5,133,835 | A | 7/1992 | Goettmann et al. |
| 5,160,789 | A | 11/1992 | Barcus et al. |
| 5,209,953 | A | 5/1993 | Grupe et al. |
| 5,223,092 | A | 6/1993 | Grinnell |
| 5,266,250 | A | 11/1993 | Kroyer |
| 5,360,420 | A | 11/1994 | Cook et al. |
| 5,403,444 | A | 4/1995 | Goettmann et al. |
| 5,443,899 | A | 8/1995 | Barcus et al. |
| 5,531,728 | A | 7/1996 | Lash |
| 5,616,384 | A | 4/1997 | Goettmann et al. |
| 5,662,773 | A | 9/1997 | Frederick et al. |
| 5,667,637 | A | 9/1997 | Jewell et al. |
| 5,698,074 | A | 12/1997 | Barcus et al. |
| 5,698,688 | A | 12/1997 | Smith et al. |
| 5,731,080 | A | 3/1998 | Cousin et al. |
| 6,066,235 | A | 5/2000 | Scheinberg |
| 6,146,494 | A | 11/2000 | Seger et al. |
| 6,150,005 | A | 11/2000 | Williams et al. |
| 6,171,443 | B1 | 1/2001 | Goettmann |
| 6,251,224 | B1 | 6/2001 | Dong |
| 6,361,651 | B1 | 3/2002 | Sun |
| 6,379,497 | B1 | 4/2002 | Sandstrom et al. |
| 6,471,824 | B1 | 10/2002 | Jewell |
| 6,506,282 | B2 | 1/2003 | Hu et al. |
| 6,579,414 | B2 | 6/2003 | Jewell |
| 6,579,415 | B2 | 6/2003 | Jewell |
| 6,582,557 | B2 | 6/2003 | Jewell |
| 6,592,712 | B2 | 7/2003 | Koukoulas et al. |
| 6,592,717 | B2 | 7/2003 | Jewell |
| 6,645,642 | B2 | 11/2003 | Kulkarni et al. |
| 6,670,035 | B2 | 12/2003 | Pittman et al. |
| 6,734,335 | B1 | 5/2004 | Graef et al. |
| 6,759,567 | B2 | 7/2004 | Colman et al. |
| 6,762,138 | B2 | 7/2004 | Ferreira et al. |
| 6,782,923 | B2 | 8/2004 | Covelli |
| 6,783,853 | B2 | 8/2004 | Figuly et al. |
| 6,802,938 | B2 | 10/2004 | Mohan et al. |
| 6,812,325 | B2 | 11/2004 | Higley |
| 6,841,245 | B2 | 1/2005 | Chang et al. |
| 6,846,529 | B2 | 1/2005 | Mohan et al. |
| 6,858,702 | B2 | 2/2005 | Sun et al. |
| 6,868,662 | B2 | 3/2005 | Rodgers |

(Continued)

FOREIGN PATENT DOCUMENTS

| | | |
|---|---|---|
| WO | 2008016639 | 2/2008 |

*Primary Examiner* — José A Fortuna

(74) *Attorney, Agent, or Firm* — Thomas W. Barnes, III; Amy L. Miller

(57) ABSTRACT

The present invention relates to a durable paper or paperboard substrate containing an effective amount of synthetic fibers and having enhanced strength in the machine direction and the cross direction, as well enhanced strength through the cross section of the sheet. The present invention further relates to methods of making and using the substrate.

15 Claims, 8 Drawing Sheets

U.S. PATENT DOCUMENTS

| | | | |
|---|---|---|---|
| 6,872,445 | B2 | 3/2005 | Vinod |
| 6,877,197 | B1 | 4/2005 | Van Trump et al. |
| 6,939,442 | B2 | 9/2005 | Klimpl et al. |
| 6,939,492 | B2 | 9/2005 | Jackson et al. |
| 6,942,706 | B2 | 9/2005 | Birkinshaw et al. |
| 6,974,628 | B2 | 12/2005 | Van Trump et al. |
| 7,005,395 | B2 | 2/2006 | Zafiroglu et al. |
| 7,011,885 | B2 | 3/2006 | Chang et al. |
| 7,026,033 | B2 | 4/2006 | Fujimori et al. |
| 7,034,088 | B2 | 4/2006 | Sun et al. |
| 7,036,197 | B2 | 5/2006 | Zafiroglu et al. |
| 7,036,299 | B2 | 5/2006 | Hietpass |
| 7,166,190 | B2 | 1/2007 | Graef et al. |
| 7,666,274 | B2 * | 2/2010 | Williams et al. ..... 162/146 |
| 2003/0175456 | A1 | 9/2003 | Whittaker et al. |
| 2003/0207636 | A1 | 11/2003 | Gosavi et al. |
| 2004/0065420 | A1 | 4/2004 | Graef et al. |
| 2004/0065423 | A1 | 4/2004 | Swerin et al. |
| 2004/0084163 | A1 | 5/2004 | Kulkarni et al. |
| 2004/0123966 | A1 | 7/2004 | Altman et al. |
| 2004/0221976 | A1 | 11/2004 | Williams et al. |
| 2006/0005934 | A1 | 1/2006 | Graef et al. |
| 2006/0008513 | A1 | 1/2006 | Holbert et al. |
| 2006/0207735 | A1 | 9/2006 | Blanz et al. |
| 2007/0084574 | A1 | 4/2007 | Bunker et al. |
| 2008/0029236 | A1 | 2/2008 | Williams et al. |

* cited by examiner

DURABLE PAPER

CROSS-REFERENCE TO RELATED APPLICATIONS

This application is continuation of U.S. application Ser. No. 11/497,796, filed on Aug. 1, 2006, now U.S. Pat. No. 7,666,274.

FIELD OF THE INVENTION

The present invention relates to a durable paper or paperboard substrate containing an effective amount of synthetic fibers and having enhanced strength in the machine direction and the cross direction, as well enhanced strength through the cross section of the sheet. The present invention further relates to methods of making and using the substrate.

BACKGROUND OF THE INVENTION

It has long been desired to make a strong durable paper substrate, especially paper substrates that are useful in applications such as tag and tickets, index, bristol paper, file folder, and portfolios. Recently, plastic alternatives have been taking over the marketplace for such uses. For example, paper substrates useful for creating paper portfolios and folders have been replaced, in part, by portfolios made completely with plastic. The plastic alternatives provide the strength and durability that the market demands for such uses or portfolios and file folders. There are similar demands for other markets, such as those mentioned above. Unfortunately, the fully plastic alternatives to fully paper substrates useful in these markets are very expensive, especially when compared to the paper alternatives.

Therefore, there is a great demand to create a strong durable paper substrate that is capable of competing with plastic counterparts, yet is cost effective when compared thereto.

SUMMARY OF THE INVENTION

One object of the present invention is a paper substrate containing a plurality of natural fibers and an effective amount of at least one synthetic fiber. In one embodiment, the substrate has a CD Tear of at least 300 gms. In another, the substrate has a MIT Fold that is at least 400 counts. In another, the substrate has a Mullen Burst that is at least 85 lbs/square inch. In an additional embodiment, the plurality of natural fibers contains a plurality of hardwood fibers and a plurality of softwood fibers. In a further embodiment, the paper substrate synthetic fiber is a mono-component fiber. In still a further embodiment, the paper substrate contains a mono-component fiber made from at least one material having a melting temperature that is at least 200° C. In another embodiment, the paper substrate contains from 0.1 to 10 wt % of the synthetic fiber. In still a further embodiment, the paper substrate the substrate has a CD Tear of at least 350 gms, an MIT Fold that is at least 575 counts, and a Mullen Burst that is at least 85 lbs/square inch and contains from 0.1 to 10 wt % of the synthetic fiber. In a further embodiment, the paper substrate the substrate has a basis weight of from 100 to 150 lbs/3000 square feet. In still a further embodiment, the paper substrate has a caliper of from 9 to 13 mils. In a further embodiment, the synthetic fiber is a multicomponent and/or a bicomponent fiber containing an inner core and an outer sheath. In one embodiment, the inner core has a melting temperature that is at least 200° C. In another embodiment, the paper substrate according the outer sheath has a melting temperature that is at most 200° C. In yet another embodiment, the substrate has a CD Tear of at least 300 gms, an MIT Fold that is at least 525 counts, and a Mullen Burst that is at least 89 lbs/square inch.

Another object of the present invention is related to a method of making and using any and all of the above aspects and embodiments of the paper substrate of the present invention.

The construction and method of operation of the invention, however, together with additional objects and advantages thereof will be best understood from the following description of specific embodiments when read in connection with the accompanying examples and claims. These and additional aspects of the invention are described herein, but are in no way meant to be deemed limited to only these embodiments.

DETAILED DESCRIPTION OF THE INVENTION

Figure 1:
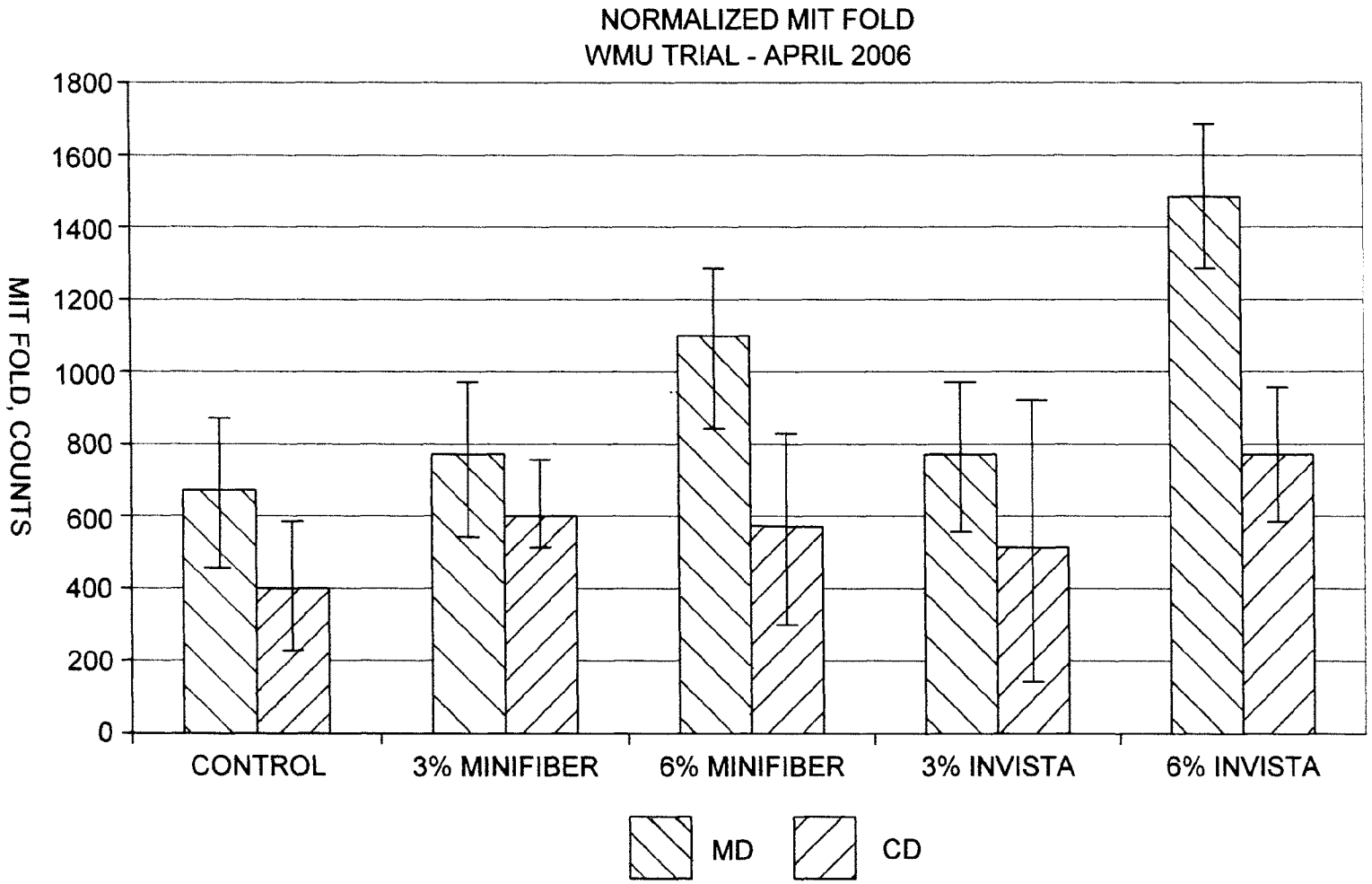
FIG. 1: A graph of the normalized CD and MD Fold of paper substrates containing different amounts of mono and bi-component fibers.
Figure 2:
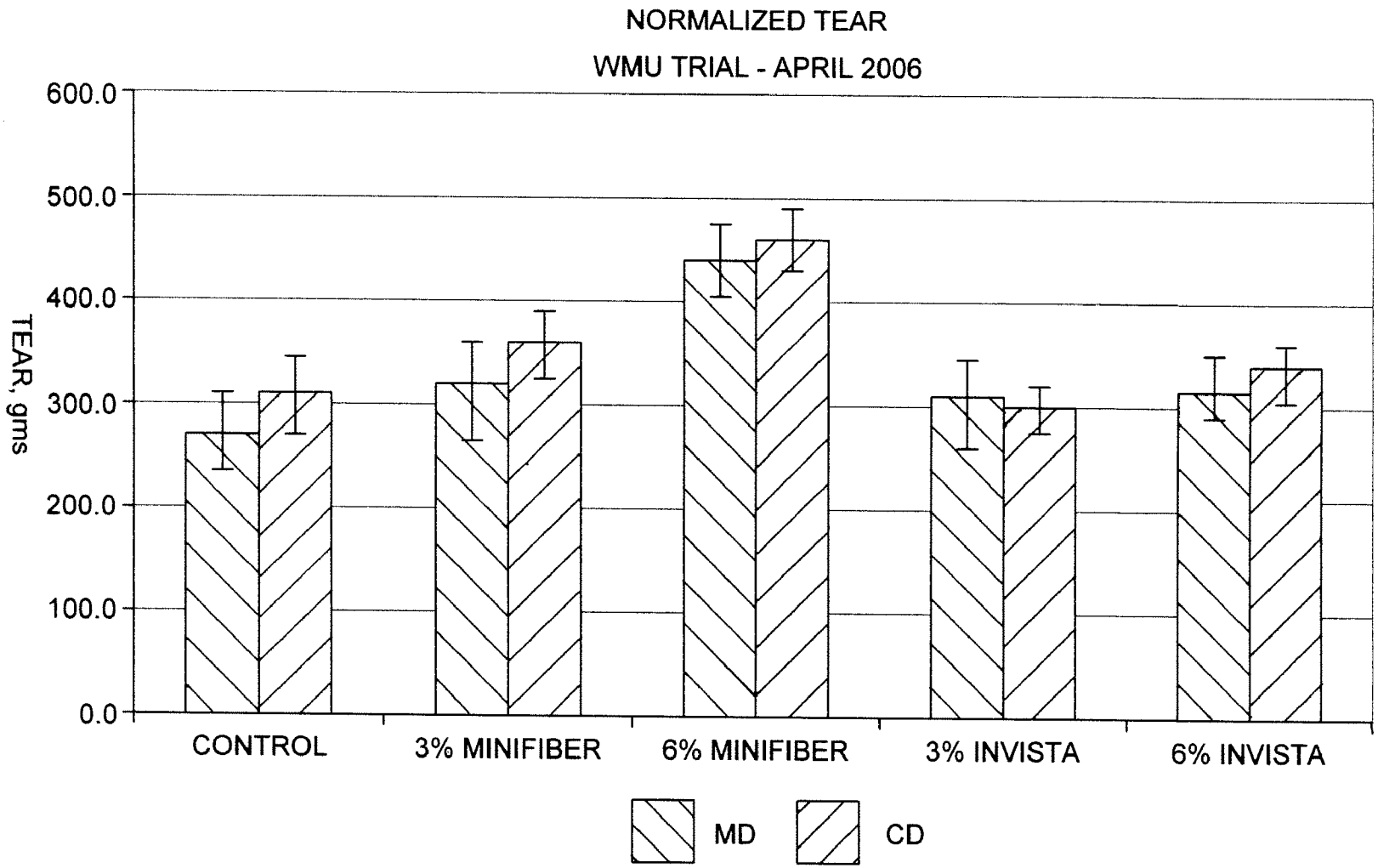
FIG. 2: A graph of the normalized CD and MD Tear of paper substrates containing different amounts of mono and bi-component fibers.
Figure 3:
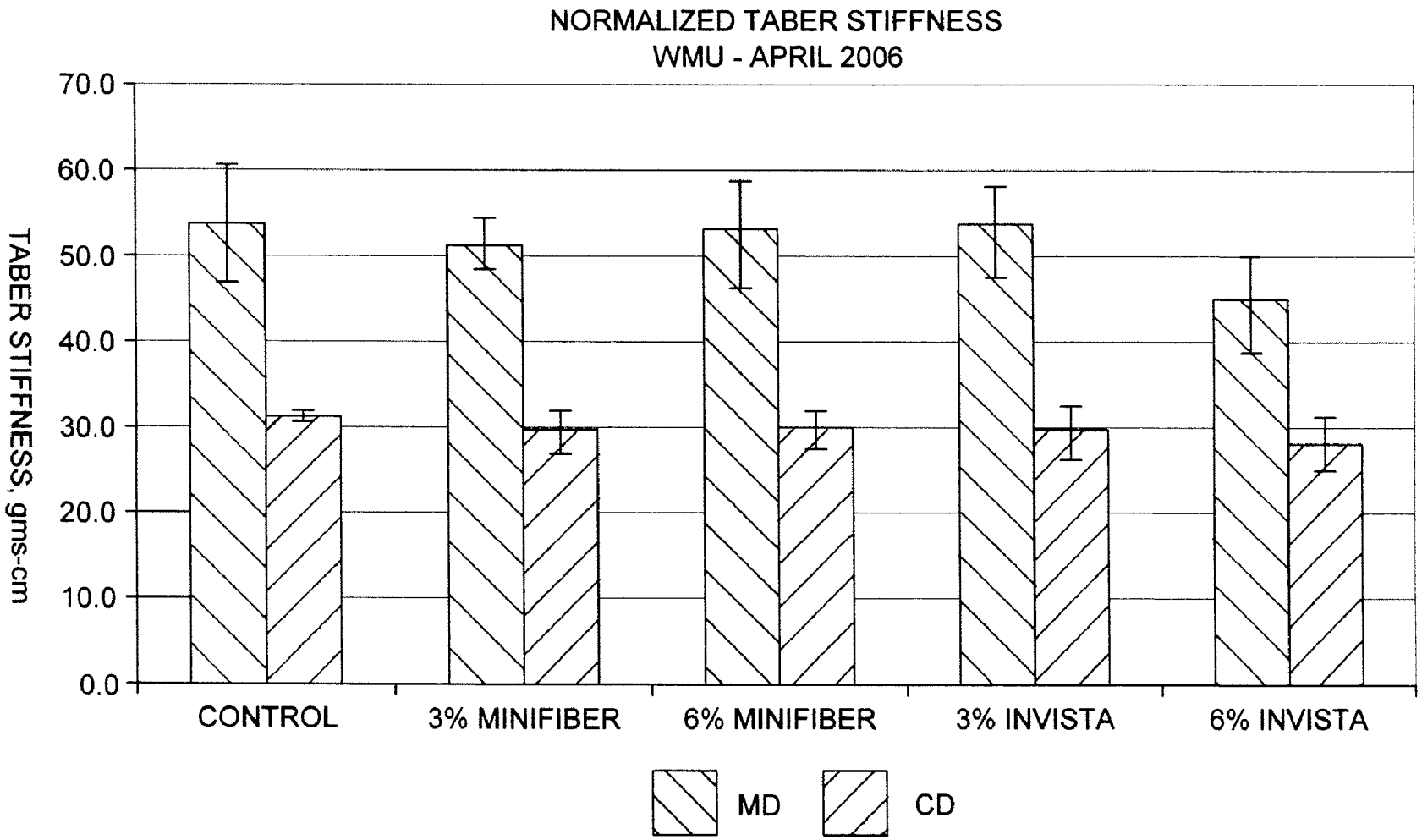
FIG. 3: A graph of the normalized CD and MD Taber Stiffness of paper substrates containing different amounts of mono and bi-component fibers.
Figure 4:
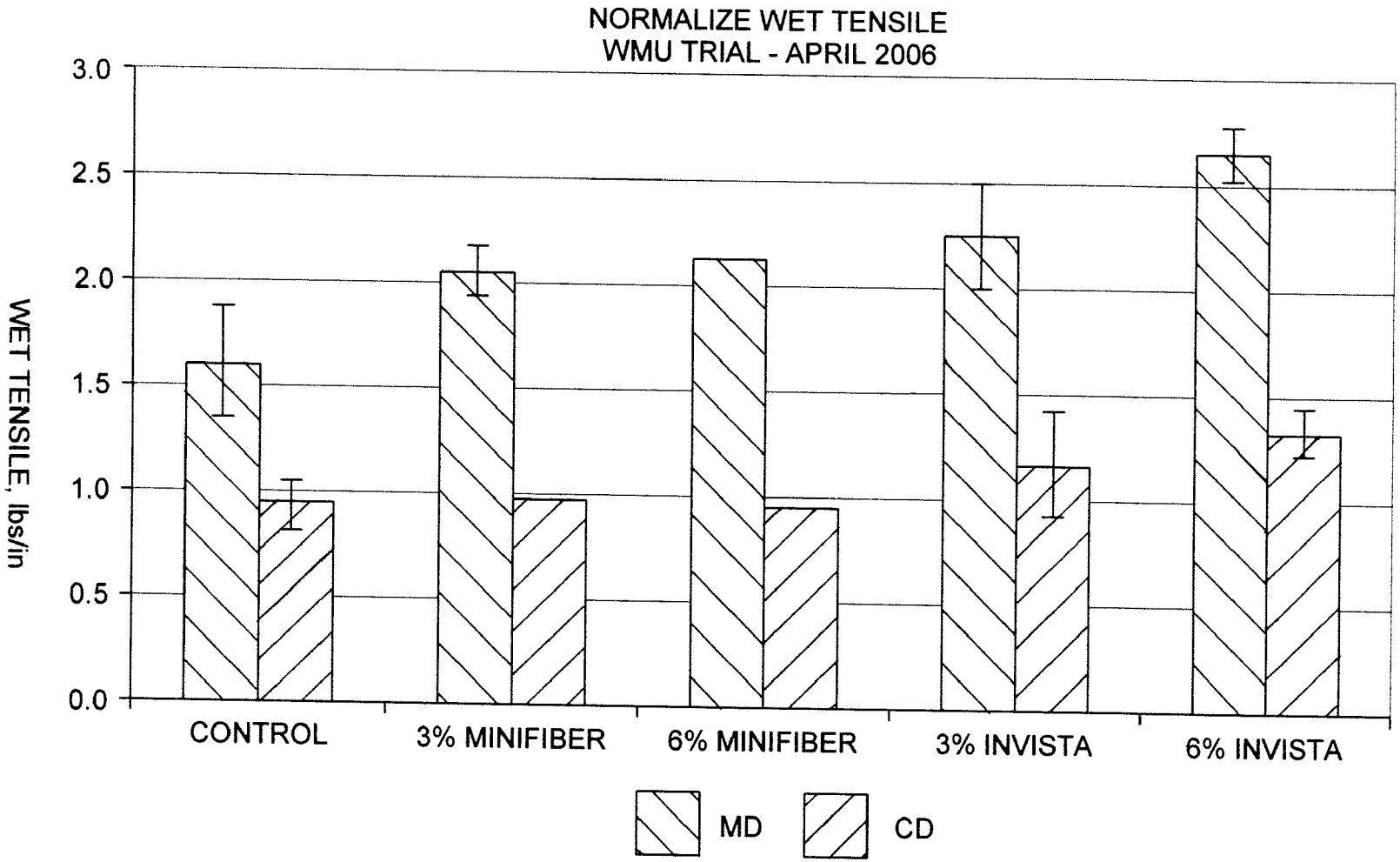
FIG. 4: A graph of the normalized CD and MD Wet Tensile of paper substrates containing different amounts of mono and bi-component fibers.
Figure 5:
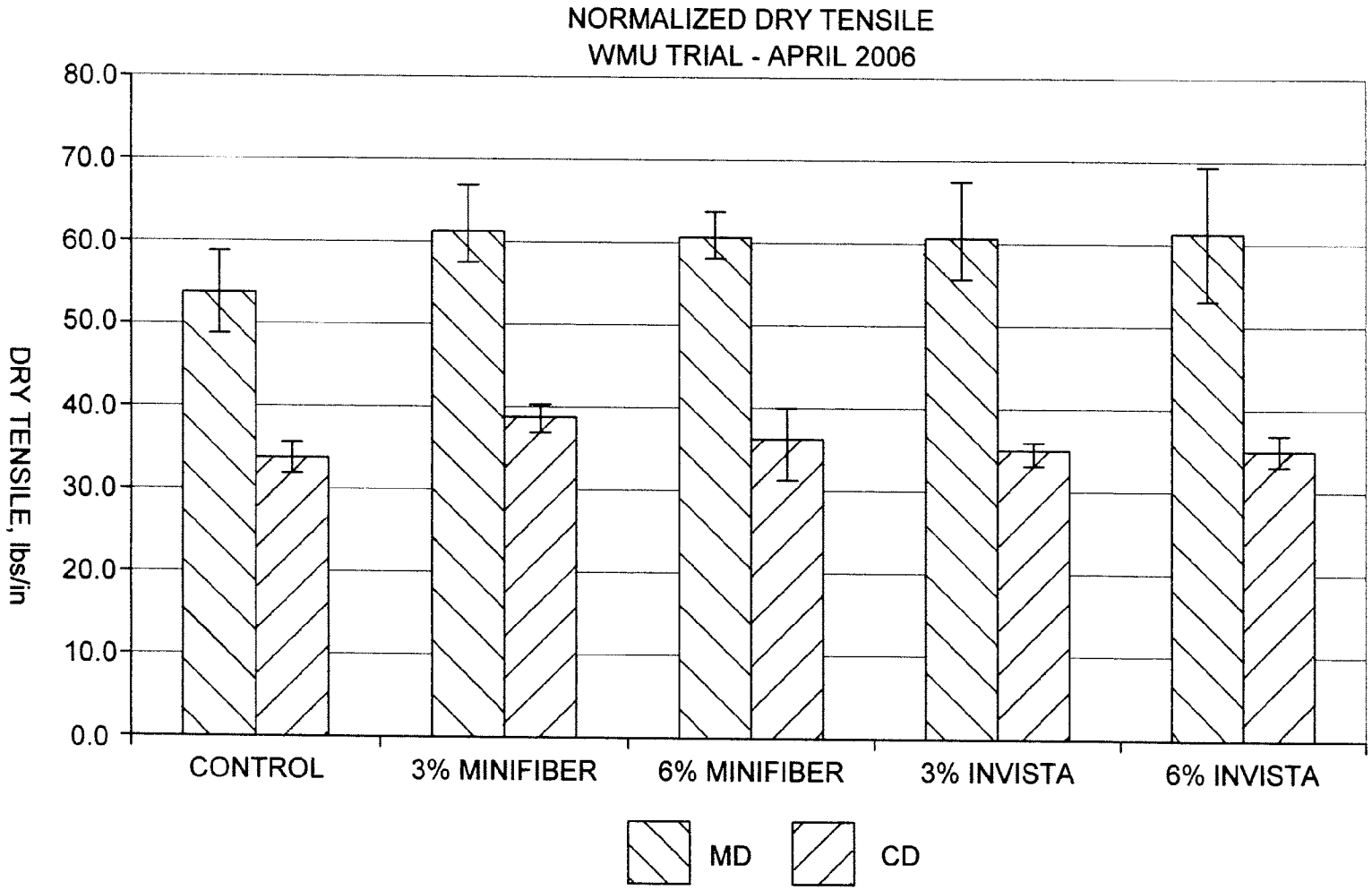
FIG. 5: A graph of the normalized CD and MD Dry Tensile of paper substrates containing different amounts of mono and bi-component fibers.
Figure 6:
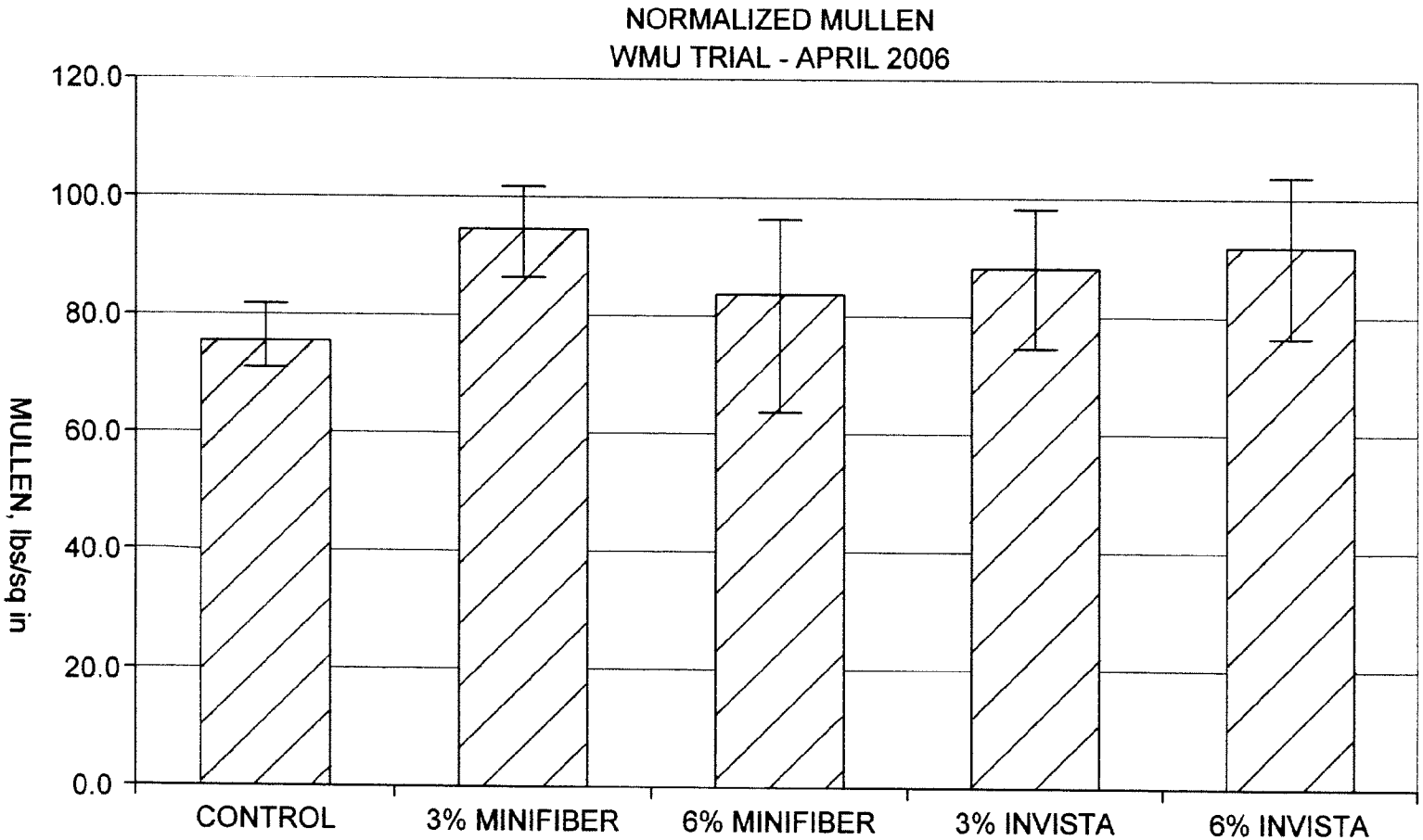
FIG. 6: A graph of the normalized Mullen Burst of paper substrates containing different amounts of mono and bi-component fibers.

The present inventors have discovered a strong durable paper or paperboard substrate that is more cost effective than the fully plastic alternatives, as well as methods of making and using the same. This paper substrate, while capable for use in any end use, is preferably suitable for use in applications such as tag and tickets, index, bristol paper, file folder, and portfolios where plastic alternatives may dominate the market, or in the alternative may be eroding the market for paper substrates.

The paper substrate contains a web of cellulose fibers. The paper substrate of the present invention may contain recycled fibers and/or virgin fibers. Recycled fibers differ from virgin fibers in that the fibers have gone through the drying process at least once.

The paper substrate of the present invention may contain from 1 to 99 wt %, preferably from 5 to 90 wt %, most preferably from 60 to 80 wt % of cellulose fibers based upon the total weight of the substrate, including 1, 5, 10, 15, 20, 25, 30, 35, 40, 45, 50, 55, 60, 65, 70, 75, 80, 85, 90, 95 and 99 wt %, and including any and all ranges and subranges therein.

Preferably, the sources of the cellulose fibers are from softwood and/or hardwood. The paper substrate of the present invention may contain from 1 to 99 wt %, preferably from 30 to 90 wt %, most preferably from 40 to 80 wt % cellulose fibers originating from softwood species based upon the total amount of cellulose fibers in the paper substrate. This range includes 1, 2, 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

The paper substrate of the present invention may contain from 1 to 99 wt %, preferably from 5 to 90 wt %, most preferably from 60 to 80 wt % cellulose fibers originating from softwood species based upon the total weight of the paper substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 100 wt % fines based upon the total weight of the paper substrate, including any and all ranges and subranges therein.

The paper substrate may contain softwood fibers from softwood species that have a Canadian Standard Freeness (csf) of from 300 to 700, more preferably from 250 to 650, most preferably from 400 to 550 csf. This range includes 300, 310, 320, 330, 340, 350, 360, 370, 380, 390, 400, 410, 420, 430, 440, 450, 460, 470, 480, 490, 500, 510, 520, 530, 540, and 550 csf, including any and all ranges and subranges therein.

The paper substrate of the present invention may contain from 1 to 99 wt %, preferably from 5 to 70 wt %, more preferably from 20 to 60 wt % cellulose fibers originating from hardwood species based upon the total amount of cellulose fibers in the paper substrate. This range includes 1, 2, 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

The paper substrate may alternatively or overlappingly contain from 0.01 to 100 wt % fibers from hardwood species, preferably from 50 to 100 wt %, most preferably from 60 to 99 wt % based upon the total weight of the paper substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95, 99 and 100 wt % fines based upon the total weight of the paper substrate, including any and all ranges and subranges therein.

The paper substrate may contain fibers from hardwood species that have a Canadian Standard Freeness (csf) of from 300 to 700, more preferably from 250 to 650, most preferably from 400 to 550 csf. This range includes 300, 310, 320, 330, 340, 350, 360, 370, 380, 390, 400, 410, 420, 430, 440, 450, 460, 470, 480, 490, 500, 510, 520, 530, 540, and 550 csf including any and all ranges and subranges therein.

When the paper substrate contains both hardwood and softwood fibers, it is preferable that the hardwood/softwood ratio be from 0.001 to 1000, more preferably from 0.2 to 2. This range may include 0.001, 0.002, 0.005, 0.01, 0.02, 0.05, 0.1, 0.2, 0.25, 0.33, 0.4, 0.5, 0.66, 0.75, 0.8, 1, 2, 5, 10, 15, 20, 25, 30, 35, 40, 45, 50, 55, 60, 65, 70, 75, 80, 85, 90, 95, 100, 200, 300, 400, 500, 600, 700, 800, 900, and 1000 including any and all ranges and subranges therein and well as any ranges and subranges therein the inverse of such ratios.

The hardwood and soft wood fibers may be any length, but preferably not less than 75 μm in length on average, more preferably not less than 80 μm in length, most preferably not less than 100 μm in length. The length of these fibers are greater than or equal to 75, 77, 80, 82, 85, 87, 90, 92, 95, 97, an 100 μm in length, including any and all ranges and subranges therein and well as any ranges and subranges therein. Also, the hard wood and softwood fibers are preferably less than 4 mm.

Further, the softwood and/or hardwood fibers contained by the paper substrate of the present invention may be modified by physical and/or chemical means. Examples of physical means include, but is not limited to, electromagnetic and mechanical means. Means for electrical modification include, but are not limited to, means involving contacting the fibers with an electromagnetic energy source such as light and/or electrical current. Means for mechanical modification include, but are not limited to, means involving contacting an inanimate object with the fibers. Examples of such inanimate objects include those with sharp and/or dull edges. Such means also involve, for example, cutting, kneading, pounding, impaling, etc means.

Examples of chemical means include, but is not limited to, conventional chemical fiber modification means including crosslinking and precipitation of complexes thereon. Examples of such modification of fibers may be, but is not limited to, those found in the following patents U.S. Pat. Nos. 6,592,717, 6,592,712, 6,582,557, 6,579,415, 6,579,414, 6,506,282, 6,471,824, 6,361,651, 6,146,494, 111,704, 5,731,080, 5,698,688, 5,698,074, 5,667,637, 5,662,773, 5,531,728, 5,443,899, 5,360,420, 5,266,250, 5,209,953, 5,160,789, 5,049,235, 4,986,882, 4,496,427, 4,431,481, 4,174,417, 4,166,894, 4,075,136, and 4,022,965, which are all hereby incorporated, in their entirety, herein by reference.

Sources of "Fines" may be found in SaveAll fibers, recirculated streams, reject streams, waste fiber streams. The amount of "fines" present in the paper substrate can be modified by tailoring the rate at which such streams are added to the paper making process.

The paper substrate preferably contains a combination of hardwood fibers and softwood fibers; and optionally "fines" fibers. "Fines" fibers are, as discussed above, recirculated at least once and may be any length, preferably fines may are not more that 100 μm in length on average, preferably not more than 90 μm, more preferably not more than 80 μm in length, and most preferably not more than 75 μm in length. The length of the fines are preferably not more than 5, 10, 15, 20, 25, 30, 35, 40, 45, 50, 55, 60, 65, 70, 75, 80, 85, 90, 95, and 100 μm in length, including any and all ranges and subranges therein.

The paper substrate may contain from 0.01 to 100 wt % fines, preferably from 0.01 to 50 wt %, most preferably from 0.01 to 15 wt % based upon the total weight of the substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 100 wt % fines based upon the total weight of the paper, including any and all ranges and subranges therein.

The paper substrate may alternatively or overlappingly contain from 0.01 to 100 wt % fines, preferably from 0.01 to 50 wt %, most preferably from 0.01 to 15 wt % based upon the total weight of the fibers contained by the paper substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 100 wt % fines based upon the total weight of the fibers contained by the paper substrate, including any and all ranges and subranges therein.

The above-mentioned naturally occurring fiber may be from woody sources, such as softwood and/or hardwood trees. In certain embodiments, at least a portion of the cellulose/pulp fibers may be provided from non-woody herbaceous plants including, but not limited to, kenaf, hemp, jute, flax, sisal, corn, cotton, or abaca although legal restrictions and other considerations may make the utilization of hemp and other fiber sources impractical or impossible. Either bleached or unbleached pulp fiber may be utilized in the process of this invention.

The paper substrate may also contain synthetic fibers. A synthetic fiber is made by the hands of man, rather than naturally occurring fibers such as those mentioned above. The synthetic fibers may be staple fibers and/or nonwoven fibers as well.

The typical man-made fiber is a polyester such as polyethylene terepthalate. However, as will be appreciated, the synthetic fiber component is not limited to polyesters, but can include other synthetic and man-made fibers that are either non-cellulosic or cellulosic in nature such as for example polypropylene. For example, cellulose acetate, nylon or polyolefin fibers such as polypropylene fibers also may be used. Further, the synthetic fiber may be made of artificial fibers such as for example, rayon. Still further the synthetic fiber may be made of acrylic and/or modacrylic containing polymers. Examples of acrylic and/or modacrylic containing polymers are those unmodified and/or modified acrylic fibers made from preferably acrylonitriles. Still further, the synthetic fiber may be made of a an olefin-containing compound and/or polylactic acid (or polylactide). Further examples of synthetic fibers and materials used to make the same can be found in U.S. Pat. Nos. 6,939,492; 7,026,033; 6,762,138; 6,150,005; 5,616,384; 5,403,444; 5,133,835; RE32, 182; 4,512,849; 4,466,862; 4,200,488; 4,049,491; and 4,007,083, 965, which are all hereby incorporated, in their entirety, herein by reference.

The synthetic fibers may be made of any of the above materials or combinations thereof. Further, the synthetic fibers may be a mono-component fiber and/or a multi-component fiber. An example of a monocomponent fiber is one that contains predominantly one of the above mentioned materials, while a multi-component fiber contains more than one of these materials. In one embodiment, the fiber is a bicomponent fiber. The bicomponent fiber may have an inner core and an outer sheath. The inner core may contain a first material, for example, the materials mentioned above. The outer sheath may contain a second material, for example, another material mentioned above.

Examples of bicomponent fibers may include those mentioned in U.S. Pat. Nos. 7,036,299; 7,036,197; 7,034,088; 7,011,885; 7,005,395; 6,974,628; 7 6,942,706; 6,877,197; 6,872,445; 6,868,662; 6,858,702; 6,841,245; 6,812,325; 6,783,853; and 6,782,923. Both the bicomponent and monocomponent fibers may be made from any one or more of the materials described therein.

In one preferred embodiment, the fiber is a monocomponent synthetic fiber that contains s material having melting point that is higher than the web temperature during drying the paper substrate in the papermaking process. The drying temperature can be any conventional papermaking drying temperature. Accordingly, the melting temperature of the monocomponent synthetic fiber may be any melting temperature so long as it is greater than the web temperature of the substrate during the drying stage in the papermaking process.

In another preferred embodiment, the fiber is a multicomponent synthetic fiber (more preferably a bicomponent synthetic fiber) containing an inner core containing a material having a melting temperature that is higher than the web temperature during drying the paper substrate in the papermaking process. The drying temperature can be any conventional papermaking drying temperature. Accordingly, the melting temperature of the core of the synthetic fiber may be any melting temperature so long as it is greater than the web temperature of the substrate during the drying stage in the papermaking process. In addition, the multi-component synthetic fiber may contain an outer sheath containing a material having a melting temperature that is less than the web temperature of the substrate during the drying stage in the papermaking process. Accordingly, the melting temperature of the outer sheath of the synthetic fiber may be any melting temperature so long as it is less than the web temperature of the substrate during the drying stage in the papermaking process. This is due to the fact that multicomponent and/or bicomponent fibers containing the outer sheath may provide additional strength enhancement at a point in the drying section of papermaking when the outer sheaths of two or more fibers in close proximity melt and/or plasticize (while the inner cores of the same remain consistent) into one another; and then, are allowed to cool. This promotes an additional mode of bonding between the multicomponent and/or bicomponent fibers when two or more wet laid multicomponent and/or bicomponent fibers. This bonding preferably occurs between the multicomponent and/or bicomponent fibers and preferably augments a hydrogen bonding network that remains intact between the natural fibers discussed above. The synthetic and/or monocomponent and/or multicomponent and/or bicomponent fibers may or may not contribute to the hydrogen bonding network, depending on which material such fibers contain and which material is exposed to the hydrogen bond network of naturally occurring fibers (i.e. if the material contains hydrogen bond donors and/or acceptors, as well as their polarity). Such additional bonding can not occur if the melting temperature of the outer sheath is greater than the web temperature of the substrate during the drying stage of the papermaking process.

The web temperature of the paper substrate may be any temperature during drying, but preferably the web temperature is from 180° C. to 300° C., more preferably from 190° C. to 270° C., most preferably from 200° C. to 250° C. The web temperature may be 180, 190, 200, 210, 220, 230, 240, 250, 260, 270, 280, 290, and 300° C., including any and all ranges and subranges therein.

The melting temperature of the synthetic fiber or the core of the multicomponent fiber is preferably greater than that of the web temperature of the paper substrate during the drying stage of the papermaking process. Accordingly, the melting temperature of the monocomponent fiber or the core of the multicomponent fiber is greater than 180° C., preferably greater than 190° C., more preferably greater than 200° C., and most preferably greater than 225° C. The melting temperature of the monocomponent fiber or the core of the multicomponent fiber may be greater than 180, 190, 200, 210, 220, 230, 240 and 250° C., including any and all ranges and subranges therein.

The melting temperature of the sheath of the multicomponent fiber may be less than 250° C., preferably less than 225° C., more preferably less than 210° C., most preferably less than 200° C. The melting temperature of the multicomponent fiber may be less than 300, 275, 250, 240, 230, 220, 210, 200, 190, and 180° C., including any and all ranges and subranges therein.

Synthetic fibers may be of any denier per filament (dpf), but preferably of a low denier of about 1 to 9 dpf, more preferably about 2 to 8 dpf, and most preferably from about 3 to 6 dpf. The synthetic fiber may have 1, 2, 3, 4, 5, 6, 7, 8, and 9 dpf, including any and all ranges and subranges therein.

The synthetic fiber may have any length, but preferably the length of the synthetic fiber is a length greater than about 4 mm, more preferably from about 8 to about 25 mm, most preferably from 10 to 15 mm. The synthetic fiber may have a length of 4, 5, 6, 7, 8, 9, 10, 11, 12, 13, 14, 15, 16, 17, 18, 19, and 20 mm, including any and all ranges and subranges therein.

The paper substrate may contain any amount of the synthetic fiber so long as the amount is effective in increasing the strength and/or durability of the paper substrate. There are many ways in which strength and/or durability of the substrate may be analyzed. Examples of such standard tests are as follows: MIT fold as measured by standard Test Tappi T511; Tear as measured by standard Test Tappi T414; Taber Stiffness as measured by standard Test Tappi T489 or T566 (Used when the number is between 0-10); Wet Tensile as measured by standard Test Tappi T456; Dry Tensile as measured by standard Test Tappi T494; and Mullen Burst as measured by standard Test Tappi T807. The substrate of the present invention preferably contains an effective amount of synthetic fiber. An effective amount of synthetic fiber is capable of increasing the durability and/or strength of the substrate as compared to substrates not containing an effective amount of synthetic fiber. More preferably, an effective amount of synthetic fiber is an amount that is present in the paper substrate so as to improve at least one of MIT fold (CD and/or MD), Tear (CD and/or MD), Taber Stiffness (CD and/or MD), Wet Tensile (CD and/or MD), Dry Tensile (CD and/or MD), and/or Mullen Burst by at least 5%, preferably at least 10%, more preferably at least 25%, most preferably at least 50% as compared to a substrate not containing an effective amount of synthetic fiber. The increase in at least one of MIT fold (CD and/or MD), Tear (CD and/or MD), Taber Stiffness (CD and/or MD), Wet Tensile (CD and/or MD), Dry Tensile (CD and/or MD), and/or Mullen Burst may be at least 5, 10, 15, 20, 25, 30, 35, 40, 45, 50, 55, 60, 65, 70, 75, 80, 85, 90, 95, 100, 125, 150, 200, 250, 300, 400, 500, 600, 700, 800, 900, and 1000%, as compared to a substrate not containing an effective amount of synthetic fiber, including any and all ranges and subranges therebetween.

Although the substrate of the present invention may contain any effective amount of synthetic fibers, it is preferable that the synthetic fiber be in the minority as compared to the total fiber furnish. That is, it is preferable that natural woody and/or non woody fibers make up at least a majority of the fiber furnish. The substrate may contain greater than 0.01 wt %, more preferably greater than 0.1 wt %, most preferably greater than 0.5 wt % of the synthetic fiber based upon the total weight of the substrate. Further, the substrate may contain at preferably not more than 10 wt %, more preferably not more than 8 wt %, most preferably not more than 6 wt % of the synthetic fiber based upon the total weight of the sheet. The substrate may contain 0.01, 0.1, 0.5, 1.5, 2, 2.5, 3, 3.5, 4, 4.5, 5, 5.5, 6, 6.5, 7, 7.5, 8, 8.5, 9, 9.5, and 10 wt % of the synthetic fiber, based upon the total weight of the sheet, including any and all ranges and subranges therebetween.

In an additional embodiment, when the substrate contains hardwood fibers and softwood fibers, the substrate may be made by replacing from 0.01 to 10%, preferably from 1 to 9%, more preferably from 2 to 8%, most preferably from 3 to 6% of any one of the softwood fibers, the hardwood fibers, or combinations thereof with the synthetic fiber. The substrate may be made by replacing 0.01, 0.1, 0.5, 1, 1.5, 2, 2.5, 3, 3.5, 4, 4.5, 5, 5.5, 6, 6.5, 7, 7.5, 8, 8.5, 9, 9.5, and 10% of either the softwood fibers, the hardwood fibers, or combinations thereof with the synthetic fiber, including any and all ranges and subranges therebetween.

The paper substrate according to the present invention may be made off of the paper machine having any basis weight. The paper substrate may have either a high or low basis weight, including basis weights of at least 10 lbs/3000 square foot, preferably from at least 20 to 500 lbs/3000 square foot, more preferably from at least 40 to 325 lbs/3000 square foot, and most preferably from 100 to 150 lbs/3000 square foot. The basis weight may be 10, 20, 30, 40, 50, 60, 70, 80, 90, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 425, 450, 475, and 500 lbs/3000 square foot, including any and all ranges and subranges therein. Of course these weights can easily be converted so as to be based upon 1300 square foot.

The paper substrate according to the present invention may have an apparent density of from 1 to 20, preferably 3 to 19, more preferably from 5 to 16, most preferably from 8 to 15 lb/3000 sq. ft.per 0.001 inch thickness. The paper substrate may have an apparent density of 1, 2, 3, 4, 5, 6, 7, 8, 9, 10, 11, 12, 13, 14, 15, 16, 17, 18, 19, and 20 lb/3000 sq. ft.per 0.001 inch thickness, including any and all ranges and subranges therein. Of course, these densities can easily be converted so as to be based upon 1300 square foot.

The paper substrate according to the present invention may have a caliper of from 2 to 35 mil, preferably from 5 to 30 mil, more preferably from 7 to 20 mil, most preferably from 10 to 12 mil. The paper substrate may have a caliper that is 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, and 35 mil, including any and all ranges and subranges therein. Any of the above-mentioned calipers of the present invention may be that of the paper substrate of the present invention either prior to or after calendaring means, such as those mentioned later below.

The paper substrate according to the present invention may have any MIT Fold (either CD and/or MD), but preferably has a MIT Fold that is not less than 450, more preferably not less than 475, and most preferably not less than 500 counts. The paper substrate may have a MIT Fold that is 450, 460, 475, 480, 490, 500, 510, 520, 530, 540, 550, 560, 570, 580, 590, 600, 625, 650, 675, 700, 725, 750, 775, 800, 900 and 1000 counts, including any and all ranges and subranges therein.

The paper substrate according to the present invention may have any Tear (either CD or/and MD), but preferably has a Tear that is not less than 300, more preferably not less than 310, and most preferably not less than 330 gms. The paper substrate may have a Tear that is 300, 310, 320, 330, 340, 350, 360, 370, 380, 390, 400, 410, 420, 430, 440, 450, 460, 475, 480, 490, 500, 510, 520, 530, 540, 550, 560, 570, 580, 590, 600, 625, 650, 675, and 700 gms, including any and all ranges and subranges therein.

The paper substrate according to the present invention may have any Wet Tensile (either CD or/and MD), but preferably has a Wet Tensile that is not less than 1.0, more preferably not less than 1.01, and most preferably not less than 1.10 gm-cm. The paper substrate may have a Wet Tensile that is 1.00, 1.01, 1.02, 1.03, 1.04, 1.05, 1.06, 1.07, 1.08, 1.09, 1.10, 1.11, 1.12, 1.13, 1.14, 1.15, 1.16, 1.17, 1.18, 1.19, 1.20, 1.21, 1.22, 1.23, 1.24, 1.25, 1.3, 1.4, and 1.5 gm-cm, including any and all ranges and subranges therein.

The paper substrate according to the present invention may have any Wet Tensile (either CD or/and MD), but preferably has a Wet Tensile that is not less than 1.0, more preferably not less than 1.01, and most preferably not less than 1.10 gm-cm. The paper substrate may have a Wet Tensile that is 1.00, 1.01, 1.02, 1.03, 1.04, 1.05, 1.06, 1.07, 1.08, 1.09, 1.10, 1.11, 1.12, 1.13, 1.14, 1.15, 1.16, 1.17, 1.18, 1.19, 1.20, 1.21, 1.22, 1.23, 1.24, 1.25, 1.3, 1.4, and 1.5 gm-cm, including any and all ranges and subranges therein.

The paper substrate according to the present invention may have any Mullen Burst, but preferably has a Mullen Burst that is not less than 78, more preferably not less than 85, and most preferably not less than 89 lbs/square inch. The paper substrate may have a Mullen Burst that is 80, 81, 82, 83, 84, 85, 86, 87, 88, 89, 90, 91, 92, 93, 94, 95, 96, 97, 98, 99, 100, 102, 105, 107, 110, 115, 120, 125, and 130 lbs/square inch, including any and all ranges and subranges therein.

The paper substrate of the present invention may have a Mullen Burst/Basis weight ratio that is at least 0.5, more preferably at least 0.66, most preferably at least 0.75. The Mullen Burst/Basis weight ration may be 0.5, 0.6, 0.7, 0.8, 0.9, 1.0, 1.1, 1.2, 1.3, 1.4, and 1.5, including any and ranges and subranges therein.

The paper substrate of the present invention may have a Tear (CD and/or MD)/Basis Weight Ratio that is greater than 2, and preferably from about 2 to about 7, more preferably from 3 to 6. The Tear (CD and/or MD)/Basis Weight Ratio may be at least 2, 2.5, 3, 3.5, 4, 4.5, 5, 5.5, 6, 6.5, and 7, including any and ranges and subranges therein.

The paper substrate of the present invention may have a MIT Fold (CD and/or MD)/Basis Weight Ratio that is greater than 3, and preferably from 3 to 10, most preferably from 4 to 8. The MIT Fold (CD and/or MD)/Basis Weight Ratio may be at least 3, 3.5, 4, 4.5, 5, 5.5, 6, 6.5, 7, 7.5 8, 8.5, 9, 9.5, and 10, including any and ranges and subranges therein.

The synthetic fiber may be contacted with the paper substrate at any point in the papermaking process. The contacting may occur anytime in the papermaking process including, but not limited to the thick stock, thin stock, head box, size press, water box, and coater. Further addition points include machine chest, stuff box, and suction of the fan pump. The most preferred methodology is by mixing the synthetic fiber at its effective amounts with the natural woody or non-woody fiber at the wet end of papermaking, more preferably prior to the head box.

The paper substrate of the present invention may also include optional substances including pigments, dyes, and optical brightening agents, fillers not in the form of a fiber-filler complex, retention aids, sizing agents (e.g. AKD and ASA), binders, thickeners, and preservatives. Examples of binders include, but are not limited to, polyvinyl alcohol, Amres (a Kymene type), Bayer Parez, polychloride emulsion, modified starch such as hydroxyethyl starch, starch, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate. Other optional substances include, but are not limited to silicas such as colloids and/or sols. Examples of silicas include, but are not limited to, sodium silicate and/or borosilicates. Another example of optional substances is solvents including but not limited to water.

The optional substances include bulking agents. Examples of such bulking agents include, but are not limited to expandable microspheres. Further examples of bulking agents include those found in U.S. Pat. Nos. 6,379,497; 6,846,529; and 6,802,938, as well as United States Published Application having Publication Number; 2004-0065423 and U.S. Pending patent application having U.S. Ser. No. 11/374,239 entitled "COMPOSITIONS CONTAINING EXPANDABLE MICROSPHERES AND AN IONIC COMPOUND, AS WELL AS METHODS OF MAKING AND USING THE SAME", filed Mar. 13, 2006, which are all hereby, in their entirety, herein incorporated by reference.

The paper substrate of the present invention may contain retention aids selected from the group consisting of coagulation agents, flocculation agents, and entrapment agents dispersed within the bulk and porosity enhancing additives cellulosic fibers. Examples of such retention aids are those described in U.S. Pat. No. 6,379,497, which is hereby, in its entirety, herein incorporated by reference.

The paper substrate of the present invention may contain the optional substances at any amount, but the amount may be from 0.001 to 50 wt % of the optional substances based on the total weight of the substrate, preferably from 0.01 to 10 wt %, most preferably 0.1 to 5.0 wt %, of each of at least one of the optional substances. This range includes 0.001, 0.002, 0.005, 0.006, 0.008, 0.01, 0.02, 0.03, 0.04, 0.05, 0.1, 0.2, 0.4, 0.5, 0.6, 0.7, 0.8, 0.9, 1, 2, 4, 5, 6, 8, 10, 12, 14, 15, 16, 18, 20, 22, 25, 30, 35, 40, 45 and 50 wt % based on the total weight of the substrate, including any and all ranges and subranges therein.

The optional substances may be dispersed throughout the cross section of the paper substrate or may be more concentrated within the interior of the cross section of the paper substrate. Further, other optional substances such as binders for example may be concentrated more highly towards the outer surfaces of the cross section of the paper substrate.

In addition, the paper substrate may contain an antimicrobial agent. Examples of such antimicrobial agent can be found in United States patent applications have Publication Numbers 20060008513, 20040084163; as well as U.S. Pat. Nos. 6,939,442 and 6,645,642, which are all hereby, in their entirety, herein incorporated by reference.

In addition, the paper substrate may contain at least one hydrophobic polymer. Examples of such hydrophobic polymers may be those described in United States Patent Applications have Publication Numbers 20040084163 and 20040221976; as well as U.S. Pat. No. 6,645,642, which are all hereby, in their entirety, herein incorporated by reference.

The paper substrate of the present invention may also contain a surface sizing agent such as starch and/or modified and/or functional equivalents thereof at a wt % of from 0.05 wt % to 50 wt %, preferably from 5 to 15 wt % based on the total weight of the substrate. The wt % of starch contained by the substrate may be 0.05, 0.1, 0.2, 0.4, 0.5, 0.6, 0.7, 0.8, 0.9, 1, 2, 4, 5, 6, 8, 10, 12, 14, 15, 16, 18, 20, 22, 25, 30, 35, 40, 45 and 20 wt % based on the total weight of the substrate, including any and all ranges and subranges therein. Examples of modified starches include, for example, oxidized, cationic, ethylated, hydroethoxylated, etc. Examples of functional equivalents are, but not limited to, polyvinyl alcohol, polyvinylamine, alginate, carboxymethyl cellulose, etc.

The paper substrate may be pressed in a press section containing one or more nips. However, any pressing means commonly known in the art of papermaking may be utilized. The nips may be, but is not limited to single felted, double felted, roll, and extended nip in the presses. However, any nip commonly known in the art of papermaking may be utilized.

The paper substrate may be dried in a drying section. Any drying means commonly known in the art of papermaking may be utilized. The drying section may include and contain a drying can, cylinder drying, Condebelt drying, IR, or other drying means and mechanisms known in the art. The paper substrate may be dried so as to contain any selected amount of water. Preferably, the substrate is dried to contain less than or equal to 10% water.

The paper substrate may be passed through a size press, where any sizing means commonly known in the art of papermaking is acceptable. The size press, for example, may be a puddle mode size press (e.g. inclined, vertical, horizontal) or metered size press (e.g. blade metered, rod metered). At the size press, sizing agents such as binders may be contacted with the substrate. Optionally these same sizing agents may be added at the wet end of the papermaking process as needed. After sizing, the paper substrate may or may not be dried again according to the above-mentioned exemplified means and other commonly known drying means in the art of papermaking. The paper substrate may be dried so as to contain any selected amount of water. Preferably, the substrate is dried to contain less than or equal to 10% water.

The paper substrate may be calendered by any commonly known calendaring means in the art of papermaking. More specifically, one could utilize, for example, wet stack calendering, dry stack calendering, steel nip calendaring, hot soft calendaring or extended nip calendering, etc.

The paper substrate may be microfinished according to any microfinishing means commonly known in the art of papermaking. Microfinishing is a means involving frictional processes to finish surfaces of the paper substrate. The paper substrate may be microfinished with or without a calendering means applied thereto consecutively and/or simultaneously. Examples of microfinishing means can be found in United States Published Patent Application 20040123966 and references cited therein, which are all hereby, in their entirety, herein incorporated by reference.

The present invention is explained in more detail with the aid of the following embodiment example which is not intended to limit the scope of the present invention in any manner.

EXAMPLES

Example 1

Synthetic fibers were blended with pulp fibers to increase the strength, primarily fold and tear, of the sheet. The synthetic fibers used were either ½ in 6 denier monocomponent Poly(ethylene terephthalate) (PET) commercially available from MiniFiber or a ½ in 3 denier bicomponent fiber (bicomponent) containing an inner core of PET (CAS#25038-59-9, 26006-30-4, and 24938-04-3) and an outer sheath containing copolyesters (CAS #26006-30-4 and 24938-04-3) and polypropylene (CAS#9003-07-0) commercially available from Invista. The synthetic fibers were used at 3 wt % and 6 wt % loadings based upon the total weight of the fiber furnish. The resultant paper substrates were tested for the following performances: MIT Fold; Tear; Taber Stiffness; Wet Tensile; Dry Tensile; Mullen Burst. FIGS. 1 to 6 show the representative results in both the CD and MD directions of the sheet (where applicable).

The control basesheet contains of 60% softwood (SW) and 40% hardwood (HW) with addition of 2 lbs/Ton of alkenylsuccinic anhydride (ASA) at the wet-end (thin stock) and 4 lbs/Ton starch at the size press. The synthetic fibers were blended with pulp fibers at 3% and 6% loadings by replacing HW.

The synthetic fibers consisted of ½ inch, 6 denier monocomponent PET (melting point=250° C.) and ½ inch 3 denier bicomponent CoPE/PET (sheath melting point=128° C.) commercially available from MiniFiber and Invista, respectively.

Based on their melting points, the polyester monocomponent fiber (MiniFiber) is considered non-fusible at standard drying operating conditions. The web strength is enhanced mostly through the entanglement of these long fibers with pulp fibers.

In the case of the bicomponent polyolefin/polyester fibers (Invista), the softening or melting of the polymer comprising the sheath allows the fibers to form a tacky skeletal structure at crossover points. Upon cooling, this matrix also captures and binds many of the pulp fibers. In addition, the long synthetic fibers entangle with the pulp fibers. This network of entangled and fused fibers results in a basesheet with significantly enhanced strength properties when compared to regular paper.

The most effective bonding between the bicomponent synthetic fibers is achieved by controlling the drying temperature of the web. If the drying temperature is less than optimal, that is lower than the softening or the melting point of the sheath material, partial thermofusing occurs. Even though less effective, the low bonded synthetic fibers can still provide enhanced strength properties.

Table 1 below summarizes the results of key strength properties in the CD direction, except for Mullen. They have been normalized by BW (124 lbs/3000 sq ft). More comprehensive graphs of each property with the 95% confidence intervals are included in FIGS. 1-6.

TABLE 1

Strength Properties in CD Direction
Normalized by Basis Weight to 124 lbs/3000 sq ft.

| Condition | MIT Fold counts | Tear gms | Taber Stiffness gm-cm | Wet Tensile lbs/in | Dry Tensile lbs/in | Mullen lbs/sq in |
|---|---|---|---|---|---|---|
| Control | 402 | 308.2 | 31.2 | 1.00 | 33.3 | 76.4 |
| 3% MiniFiber | 598 | 358.7 | 29.7 | 1.02 | 38.3 | 94.0* |
| 6% MiniFiber | 570 | 461.0* | 29.9 | 1.01 | 36.0 | 85.1 |
| 3% Invista | 530 | 301.2 | 29.7 | 1.18 | 35.0 | 89.9* |
| 6% Invista | 757* | 335.6 | 28.0 | 1.39* | 35.2 | 93.3* |

*Statistically different than control based upon 95% confidence interval.

Results show that the inclusion of synthetic fibers resulted in directional as well as statistically significant improvements in strength properties without detrimental effects on stiffness and dry tensile.

The results indicate that a more durable sheet was achieved, with up to 90% higher CD fold and up to 50% improved CD tear, with the addition of the synthetic fibers.

In summary:

MIT Fold: The presence of long synthetic fibers had a positive effect on this property. A significant increase, almost 90% higher fold, was obtained with the bicomponent fusible fibers demonstrating the benefits of the fused matrix.

Tear: The presence of long synthetic fibers increased tear. The improvement was most significant, almost 50%, with the larger denier PET non-fusible fiber (MiniFiber) at 6% loading.

Taber Stiffness: No significant changes were observed with synthetic fibers.

Wet Tensile: A significant increase in wet tensile was obtained with the fusible bicomponent fiber due to their capabilities to generate a strong thermally bonded matrix.

Dry Tensile: No significant changes were observed with synthetic fibers.

Mullen: A significant increase in this property was observed with the presence of both the non-fusible monofilament and the fusible bicomponent synthetic fibers as the longer fiber length affects Mullen positively. The thermal interfiber bonding realized with the bicomponent fibers added to this effect.

Example 2

Determination of Tensile Strength—Temperature Profile

A lab study was conducted to establish whether the bicomponent fibers mentioned above (Invista) had thermally bonded by determining of dry/wet tensile-temperature profile. The material produced during the trial was subjected to increasing temperatures, below and above sheath melting point, in a flat dryer. The bicomponent-containing sheets made in Example 1 were used for this study. The results of this work, in graph form, are provided in FIGS. 7 and 8.

Figure 7:
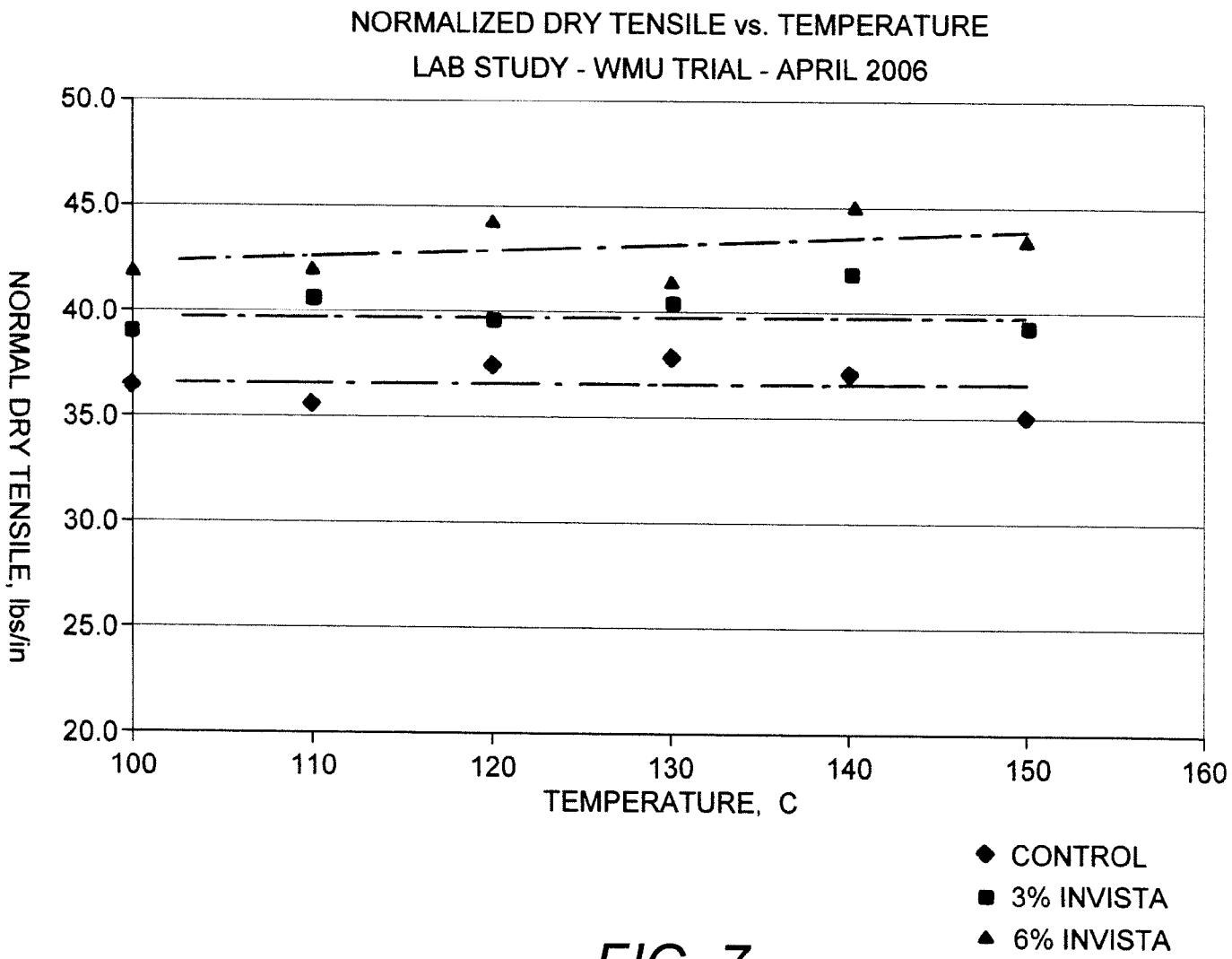
FIG. 7: A graph of the normalized Dry Tensile vs. Temperature profile for paper substrates containing different amounts of hi-component fibers.
Figure 8:
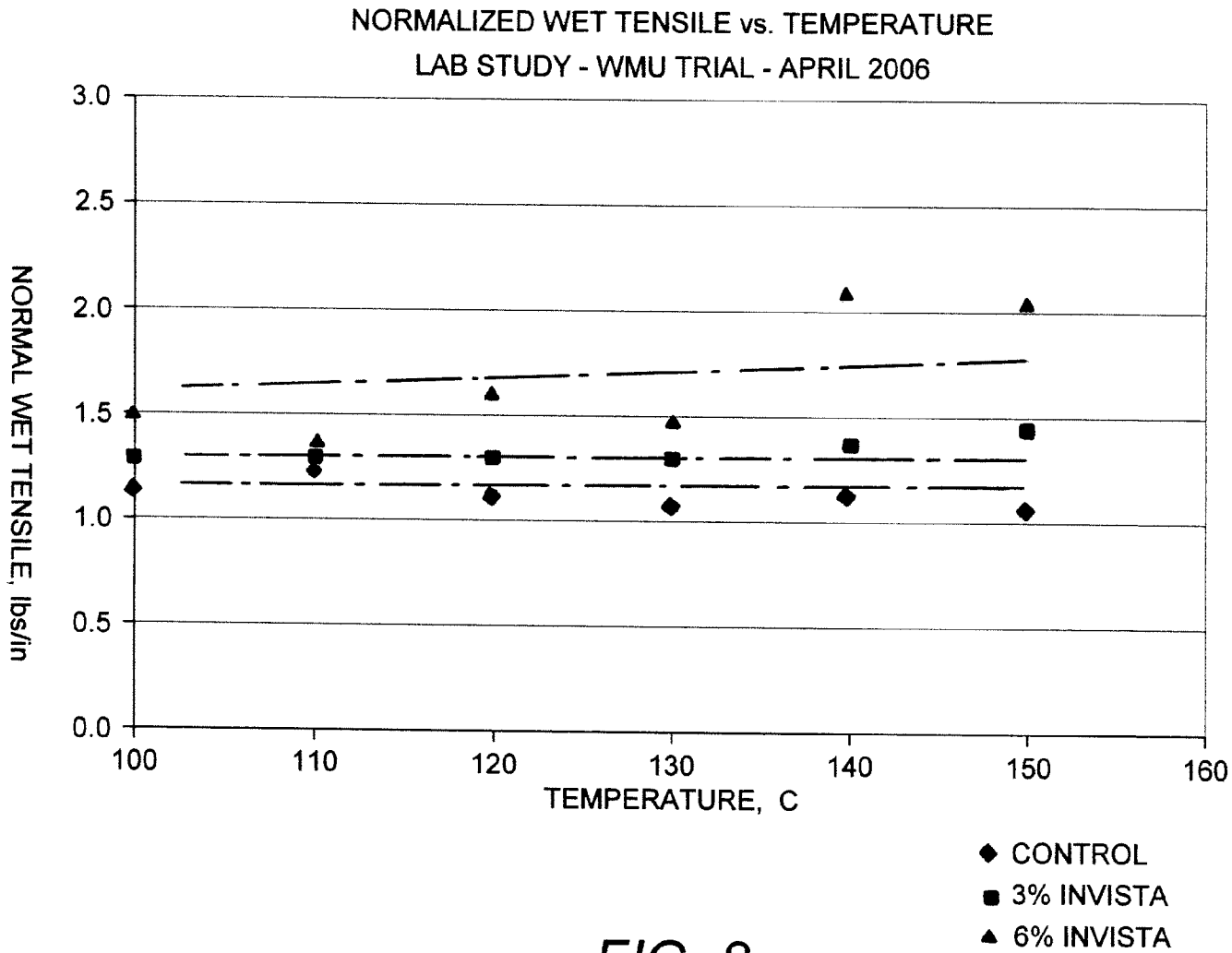
FIG. 8: A graph of the normalized Wet Tensile vs. Temperature profile for paper substrates containing different amounts of bi-component fibers.

In general, little or no differences in dry and re-wet tensile were observed as the temperature increased (see FIGS. 7 and 8). This indicates that, even at these low loading percentages, some level of thermal bonding was achieved on the pilot machine.

Numerous modifications and variations on the present invention are possible in light of the above teachings. It is, therefore, to be understood that within the scope of the accompanying claims, the invention may be practiced otherwise than as specifically described herein.

As used throughout, ranges are used as a short hand for describing each and every value that is within the range, including all subranges therein.

All of the references, as well as their cited references, cited herein are hereby incorporated by reference with respect to relative portions related to the subject matter of the present invention and all of its embodiments

What is claimed is:

1. A paper substrate, comprising a plurality of natural fibers; and from 0.1 to 10 wt % based on the total weight of the substrate of at least one multicomponent fiber comprising an inner core having a melting temperature of at least 200° C. and an outer sheath, wherein the substrate has a CD Tear of at least 300 gms, an MIT Fold that is at least 400 counts, and a Mullen Burst that is at least 85 lbs/square inch.

2. The paper substrate according to claim 1, wherein the plurality of natural fibers comprises a plurality of hardwood fibers and a plurality of softwood fibers.

3. The paper substrate according to claim 1, wherein the outer sheath has a melting temperature that is at most 200° C.

4. The paper substrate according to claim 1, wherein the multicomponent fiber is a bicomponent fiber.

5. The paper substrate according to claim 4, comprising from 3 to 6 wt % of the bicomponent fiber based upon the total weight of the substrate.

6. The paper substrate according to claim 1, wherein the substrate has a CD Tear of at least 300 gms, an MIT Fold that is at least 525 counts, and a Mullen Burst that is at least 89 lbs/square inch.

7. The paper substrate according to claim 6, wherein the substrate has a basis weight of from 100 to 150 lbs/3000 square feet and a caliper of from 9 to 13 mils.

8. The paper substrate according to claim 1, wherein the substrate has a CD Tear of at least 300 gms, an MIT Fold that is at least 525 counts, and a Mullen Burst that is at least 89 lbs/square inch.

9. The paper substrate according to claim 8, wherein the substrate has a basis weight of from 100 to 150 lbs/3000 square feet and a caliper of from 9 to 13 mils.

10. The paper substrate according to claim 1, comprising from 2 to 8 wt % of said multicomponent fiber based on the total weight of the substrate.

11. The paper substrate according to claim 1, wherein said substrate has a CD tear of at least 310 gms.

12. The paper substrate according to claim 1, wherein said substrate has an MIT fold of at least 450 counts.

13. The paper substrate according to claim 1, wherein said substrate has a Mullen Burst that is at least 95 lbs/square inch.

14. The paper substrate according to claim 1, wherein said melting temperature of said core is at least 225° C.

15. The paper substrate according to claim 1, wherein said melting temperature of said core is at least 250° C.

* * * * *